US005162079A

United States Patent [19]

Brown

[11] Patent Number: 5,162,079

[45] Date of Patent: Nov. 10, 1992

[54] PROCESS AND APPARATUS FOR CONTROL OF ELECTROPLATING BATH COMPOSITION

[75] Inventor: Craig J. Brown, Pickering, Canada

[73] Assignee: Eco-Tec Limited, Pickering, Canada

[21] Appl. No.: 646,971

[22] Filed: Jan. 28, 1991

[51] Int. Cl.[5] ..... C25D 21/12; C25D 17/00

[52] U.S. Cl. ..... 205/101; 204/105 R; 204/257; 204/263; 204/296; 204/112

[58] Field of Search ..... 204/14.1, 23, 129, 232, 204/151, 257, 263-266, 260, 252, 112, 296, 302, 186, 105 R; 205/271, 101

[56] References Cited

U.S. PATENT DOCUMENTS

| | | | |
|---|---|---|---|
| 4,105,532 | 8/1978 | Haines | 204/301 |
| 4,652,345 | 3/1987 | McBride et al. | 204/14.1 |
| 4,778,572 | 10/1988 | Brown | 204/14.1 |
| 4,880,511 | 11/1989 | Sugita | 204/151 |
| 4,906,340 | 3/1990 | Brown | 204/14.1 |
| 4,948,476 | 8/1990 | Kamperman et al. | 204/252 X |
| 5,047,126 | 9/1991 | Greenberg | 204/151 |

FOREIGN PATENT DOCUMENTS

| | | |
|---|---|---|
| 1055883 | 6/1979 | Canada . |
| 55-24924 | 2/1980 | Japan . |
| 56-112500 | 2/1980 | Japan . |
| 57-51477 | 8/1980 | Japan . |

OTHER PUBLICATIONS

Y. Kobuschi, Y. Matsunaga and Y. Noma, "Application of Ion Exchange Membranes to the Recovery of Acids by Diffusion Dialysis and Electrodialysis", Proceedings of Microsymposium on Macromolecules, Synthetic Polymeric Membranes, Walter de Gruyter & Co., New York.

A. T. Cherif, C. Gavach, T. Cohen, P. Dagard and L. Albert, 1988. "Sulfuric Acid Concentration with an Electro-Electrodialiysys Process". Hydrometallurgy, 21:191-201.

*Primary Examiner*—Donald R. Valentine
*Attorney, Agent, or Firm*—Bereskin & Parr

[57] ABSTRACT

A process and apparatus for electroplating metals in which the metal salt concentration within the electroplating bath is reduced by providing an insoluble anode assembly in the bath. The insoluble anode assembly includes an enclosure which defines a compartment around an insoluble anode and which is formed at least in part by an anion exchange membrane. The primary reaction at the insoluble anode during electroplating is electrolysis of water to produce predominantly oxygen and hydrogen ions. The flow of current through the insoluble anode assembly causes anions in the plating solution to travel through the anion membrane into the compartment, resulting in an increase in acid concentration within the compartment. Accumulated acid is periodically flushed from the compartment.

21 Claims, 2 Drawing Sheets

PROCESS AND APPARATUS FOR CONTROL OF ELECTROPLATING BATH COMPOSITION

FIELD OF THE INVENTION

This invention relates to a process and apparatus for electroplating metals.

BACKGROUND OF THE INVENTION

In many electroplating operations the dissolved metal concentration in the electroplating solution has a tendency to increase beyond the concentration considered optimal for electroplating, due to the fact that the cathode efficiency is less than the anode efficiency. Some electroplating companies have accumulated considerable quantities of excess plating solution as a consequence of decanting solution from the plating baths to counteract this problem. It would be highly advantageous if the concentration of metal in these solutions could be lowered and if excess solution could be reused in the electroplating bath.

There are other instances in which it is desirable to add metal salts to a plating bath. For example, where it is desired to plate an alloy of two or more metals, it is sometimes impractical to utilize soluble anodes of two different metals. In this case, the source to the solution of at least one of the metals could be provided by additions of a metal salt; however under normal circumstances this would result in a buildup in total dissolved metal concentration of the plating solution.

DESCRIPTION OF THE PRIOR ART

U.S. Pat. No. 4,778,572 (Brown) discloses the use of an insoluble anode to stabilize the metal concentration and prevent metal buildup when the only source of metal in solution is from the anodes or recycle from dragout. However, the metal concentration is not reduced. According to the Brown invention, the amount of electrical current carried by the insoluble anode is such that the total amount of metal plated onto the workpiece is equal to the amount of metal dissolved from the anodes. In order to reduce the metal concentration, it is necessary to increase the amount of current carried by the insoluble anode and so decrease the current carried by the soluble anodes so that metal will be deposited on the workpiece at a higher rate than it is dissolved from the anodes. This can be done by further increasing the percentage of insoluble anode material in the electroplating bath. However, this will result in the generation of excess hydrogen ions and a consequent decrease in the pH level of the plating solution, which is highly undesirable.

U.S. Pat. No. 4,906,340 (also to Brown) discloses another method for controlling the buildup of metal concentration in an electroplating bath. However, this invention also cannot reduce the metal concentration for the reasons outlined above.

Addition of an alkali such as sodium hydroxide or calcium hydroxide is not a viable solution to the problem of decreasing pH, as the residual sodium or calcium ions are objectionable contaminants in many plating solutions.

Japanese patent application No. SHO 57-51477 filed Aug. 8, 1980 discloses a method of reducing the metal concentration in an electroplating solution. However, with this invention, the metal is recovered in a separate recovery cell on a cathode sheet, not on the workpiece that is being electroplated. The metal must be stripped from this cathode sheet and then reused as anode material in the electroplating bath or disposed of separately. Metal that is recovered in this manner is not suitable as anode material in some cases and must be sold as scrap at a substantial discount from its replacement value. In addition, a separate DC power source, external to that of the electroplating bath is necessary for the recovery cell.

SUMMARY OF THE INVENTION

An object of the present invention is to provide an improved process and apparatus which addresses the problem of reducing the dissolved metal concentration in an electroplating solution without causing an attendant increase in acidity that will detrimentally affect the electroplating process.

Accordingly, in one aspect, the invention provides a process for electroplating metals in an electroplating bath which contains a plating solution of a metallic salt, and a cathode comprising a workpiece to be plated. An insoluble anode assembly is provided in the bath and includes an anode which is essentially insoluble during electroplating and an enclosure which defines a compartment around the insoluble anode and which contains a solution of an electrically conductive acid, base or salt. The enclosure isolates the solution in the compartment from the plating solution and comprises at least in part an anion exchange membrane. A source of direct electric current is connected across the anode and cathode so that metal is electroplated onto the cathode. The primary reaction at the insoluble anode is electrolysis of water to produce predominantly oxygen and hydrogen ions and the flow of current through the insoluble anode assembly causes anions in the plating solution to travel through the anion membrane into the compartment defined by the said enclosure, resulting in an increase in acid concentration in said compartment. Accumulated acid is periodically flushed from the compartment.

While the process may be carried out without providing a source of metal to the plating solution, such a source will normally be provided, for example by including a soluble anode in the bath. In that event, the insoluble anode will carry a portion of the anodic current that is selected to result in the total amount of metal plated onto the cathode being greater than the total amount of metal dissolved from the soluble anode. The metal concentration of the plating solution will then be reduced. At the same time, the excess acid that is generated is confined to the compartment around the insoluble anode and can be continuously or periodically flushed from the compartment.

In its apparatus aspect, the invention provides an apparatus for electroplating metals comprising a electroplating bath which contains a plating solution of a metallic salt and a cathode comprising a workpiece to be plated. An insoluble anode assembly is also provided in the bath and includes an anode which is essentially insoluble during electroplating and an enclosure which defines a compartment around the insoluble anode and which contains a solution of an electrically conductive acid, base or salt. The enclosure isolates the solution in the compartment from the plating solution and comprises at least in part an anion exchange membrane. A source of direct electric current is provided for connection across the anodes and cathode. Means is also provided for at least periodically flushing accumulated acid from the insoluble anode compartment.

BRIEF DESCRIPTION OF DRAWINGS

In order that the invention may be more clearly understood, reference will now be made to the accompanying drawings, which illustrate a number of preferred embodiments of the invention by way of example, and in which.

DESCRIPTION OF PREFERRED EMBODIMENTS

Figure 1:
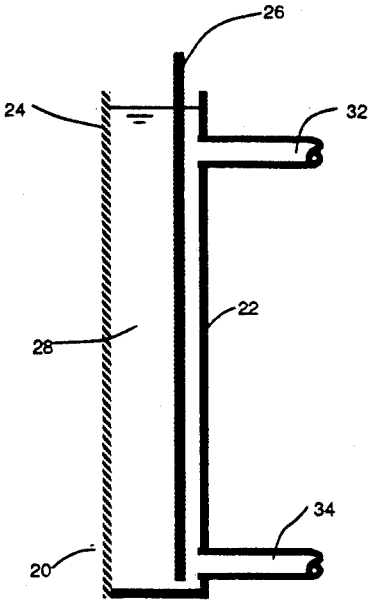
FIG. 1 is a diagrammatic vertical sectional view of an insoluble anode assembly for use in an electroplating bath.

Referring first to FIG. 1, an insoluble anode assembly or electrochemical half-cell is generally denoted by reference numeral 20 and comprises an enclosure 22 having three sides and a bottom, an anion exchange membrane 24 and an insoluble electrode 26. The anion membrane can be a standard strong base anion type such as Ionac MA3475 as manufactured by Sybron Chemical, although other membranes of similar composition may be employed. As outlined below, the choice of anion membrane is of importance in the present invention. The electrode can be fabricated from a variety of known anode materials as outlined in the '572 patent supra such as lead alloy, carbon or precious metal coated titanium. Preferably, the electrode comprises a valve metal substrate (e.g. titanium, niobium or tantalum) or valve metal oxide substrate (e.g. titanium suboxide) with a low oxygen overvoltage catalytic coating (eg. iridium oxide). The enclosure may be fabricated from a corrosion resistant plastic such as PVC or polyethylene or a valve metal such as titanium which does not carry current when charged anodically.

The anion membrane 24 is installed so that it covers the open side of enclosure 22. The membrane is sealed around the perimeter of the open side of the enclosure, if necessary with a suitable gasket arrangement (not shown) so that a compartment 28 is formed inside the enclosure. One side of the anion membrane 24 is therefore exposed. The electrode is installed inside this compartment. The compartment is then filled with an acid solution such a sulfuric acid. To avoid the risk of extraneous anions entering the system, this acid is preferably an acid whose anion is common to that of the plating solution. Inlet and outlet connections 32 and 34 respectively are provided to allow addition of solution to and its removal from compartment 28.

Figure 2:
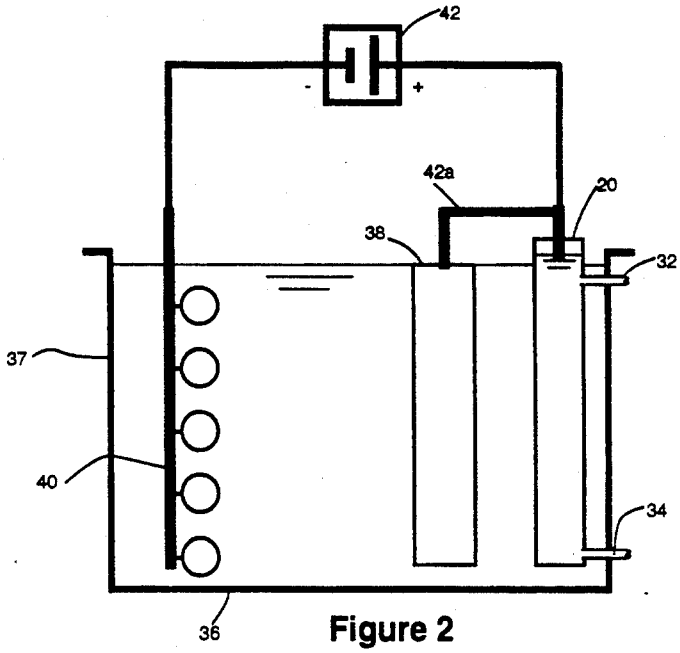
FIG. 2 is a diagrammatic vertical sectional view through a bath containing the insoluble anode assembly of FIG. 1.

Referring to FIG. 2, the insoluble anode assembly 20 is shown installed in an electroplating bath 36. Which includes a tank 37 the bath is shown to also contain one or more soluble anodes such as that indicated at 38, a cathode 40 comprising workpieces to be plated, and a power supply 42. Electrode 26 is connected to an anode bus connection **42*a* of the power supply electrically in parallel with the soluble anodes 38 in the bath. Tank 37 is filled with a metal salt containing electrolyte of the usual type and composition. For example, the metal salt may be nickel sulfate. The workpieces to be electroplated are immersed in the plating bath, and a direct electrical potential is applied by the power supply 42 between the workpieces (which form the cathode) and the anodes, including the insoluble anode assembly 20**.

Metal is deposited on the cathodic workpieces according to equation (1) (in the case of a nickel plating operation). In addition a small amount of current may result in the production of hydrogen gas at the cathodic workpieces according to equation (2).

$$Ni^{++} + 2e^- \rightarrow Ni_m \quad (1)$$

$$2H^+ + 2e^- \rightarrow H_2 \quad (2)$$

A portion of the anodic current is carried by the soluble metal anodes 38 in the bath and the remainder is carried by the insoluble anode assembly 20. Metal is dissolved from the metal anodes 38 according to equation (3).

$$Ni \rightarrow Ni^{++} + 2e^- \quad (3)$$

According to the present invention, the amount of current going to dissolving metal from the metal anodes is less than the amount of current going to plating metal at the cathodic workpieces 40, so that the metal concentration in the bath is reduced.

The electrical current flowing through the insoluble anode assembly 20 causes anions in the electroplating solution to be transported through the anion membrane 24 into compartment 28. These anions accumulate in the compartment. At the same time, water is electrolyzed at electrode 26 to produce oxygen according to equation (4), which escapes, and hydrogen ions ($H^+$). These hydrogen ions also accumulate in compartment 28 and are rejected by the anion membrane 24.

$$H_2O \rightarrow \tfrac{1}{2}O_2 + 2H^+ + 2e^- \quad (4)$$

The net result of these reactions is a reduction in the metal salt concentration of the electroplating electrolyte and a buildup in the concentration of acid in the compartment 28 of the insoluble anode assembly 20. The compartment is continuously or periodically flushed with water or a more dilute acid solution via connections 32 and 34 to remove the accumulated acid and avoid an excessive buildup in acid concentration.

The acid collected from compartment 24 can be neutralized (outside the bath) with a base such as sodium hydroxide, resulting in the production of a salt solution. This salt solution can then be reused to flush the acid from compartment 24. An excessive buildup in salt concentration in the solution used to flush compartment 24 can be avoided by purging all or part of this salt solution from time to time and replacing the purged solution with water.

Many electroplating processes such as Watts nickel and chloride zinc, employ anions other than sulfate, such as chloride, which have an undesirable reaction at the anode. Chloride anions for example react to produce toxic chlorine gas. Another embodiment of the presen invention avoids unwanted anodic reactions by isolating the electrode from the anions which have been removed via the anion membrane.

Figure 3:
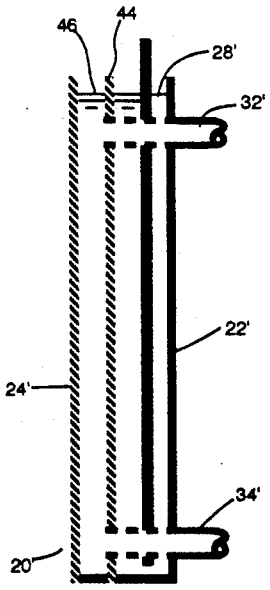
FIGS. 3 and 4 are views similar to FIGS. 1 and 2 respectively illustrating a second embodiment of the invention; and, FIG. 5 is a diagrammatic illustration of an insoluble anode assembly in accordance with a further embodiment of the invention.

FIG. 3 shows an insoluble anode assembly 20' which is similar to that described above except that a cation exchange membrane 44 is inserted between the electrode 26' and the anion membrane 24'. The cation membrane 44 is sealed to the wall of the enclosure (e.g. using a suitable gasket—not shown) and is separated from the anion membrane 24' so that a second compartment 46 is formed in the space between the two membranes. Compartment 28' (the first compartment) still contains the electrode (26') and is defined by the cation membrane 44 and the enclosure 22' In this embodiment inlet and outlet connections 32' and 34' communicate with the second compartment 46.

The cation membrane 44 can be a standard strong acid membrane such as Ionac MC3470, although other membranes of similar composition can be equally well employed. Of particular advantage is a perfluorsulfonic acid membrane such as Nafion 324, manufactured by E.I. Du Pont. Such a membrane is resistant to oxidation by agents such as gaseous chlorine, which may be generated to a small extent at the surface of the electrode 26'. Intrusion of small quantities of chloride into the first compartment 28' may occur under some circumstances due to the inherent inefficiencies of cation membranes in totally rejecting all anions.

As in the first embodiment, the first compartment 28' is filled with an acid solution, such as dilute sulfuric acid, which reacts at the anode (26') to produce oxygen. The second compartment 46 can also be filled with an acid solution and/or a highly conductive salt solution such as dilute sulfuric acid, dilute hydrochloric acid, sodium chloride, and/or sodium sulfate.

Figure 4:
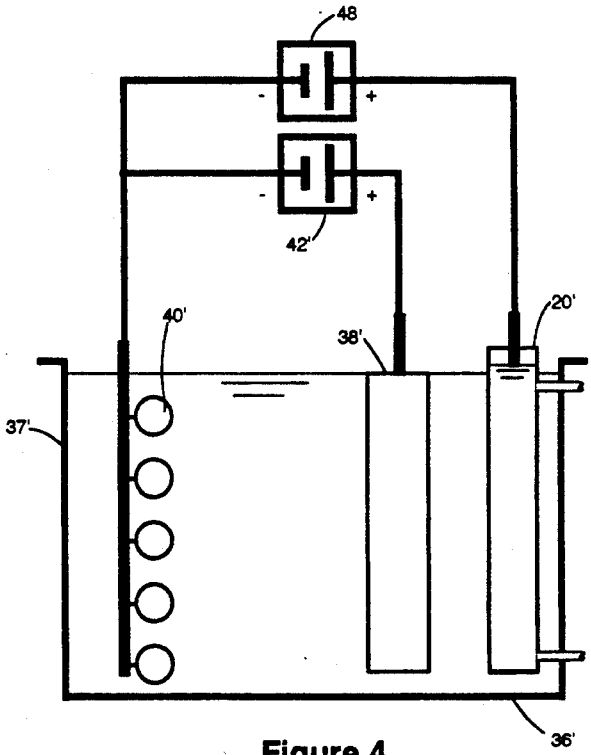

As shown in FIG. 4, insoluble anode assembly 20' is installed in a plating bath in the same fashion as shown in FIG. 2 for insoluble anode assembly 20. In FIG. 4, a separate power supply 48 is shown for assembly 20', although it is to be understood that this is no essential. Conversely, a separate power supply could be used in the first embodiment. The reason for using a separate power supply will be discussed in detail later.

During electroplating, the electrical potential between the anodes and cathode causes anions in the electroplating solution to be transported through the anion membrane 24' into the second compartment 46 of the insoluble anode assembly. These anions are rejected by the cation membrane 44 and thereby substantially prevented from entering the first compartment 28'. These anions therefore accumulate in the second compartment 46. 0f particular importance is the fact that objectionable anions such as chloride are largely prevented from entering the first compartment 28' and contacting the electrode 26', thus preventing undesirable anodic reactions such as the evolution of chlorine gas. The second compartment 46 can be flushed and replenished as described above (via connections 32' and 34') to remove accumulated acid and avoid an excessive buildup in concentration. In this embodiment, the acid solution held in the first compartment is not replaced on a regular basis, although water additions are necessary from time to time to replace water lost through evaporation and electrolysis.

Figure 5:
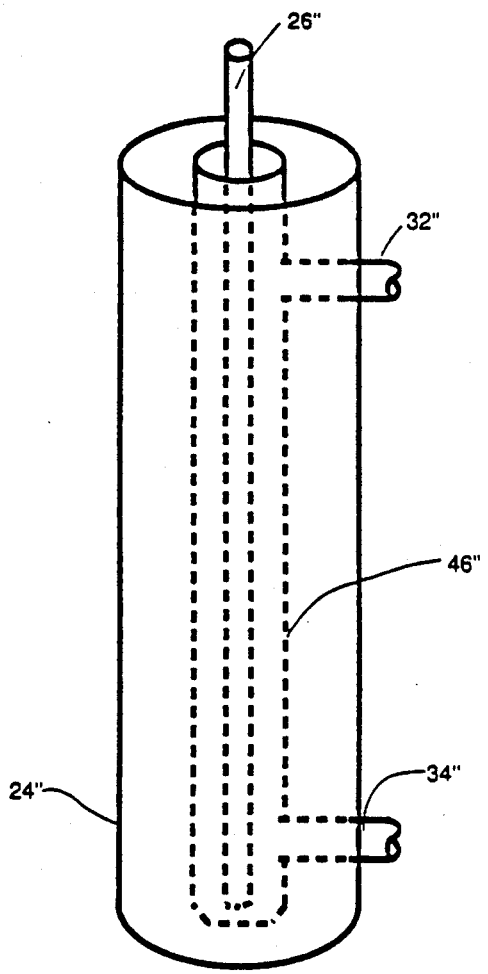

FIG. 5 illustrates the fact that the shape of the insoluble anode assembly can be other than the particular rectangular shape shown in FIGS. 1 to 4. FIG. 5 illustrates an embodiment in which two membranes are used but a similar design could of course be used for a single membrane assembly.

In FIG. 5, double primed reference numerals have been used to denote parts that correspond with parts shown in FIG. 3. It will be seen that the two membranes 24'' and 44'' are fabricated as concentric tubes that surround the insoluble anode 26''. At their lower ends, the membrane tubes are sealed to a disc-shaped base 50.

In practice, cylindrical or rectangular configurations will normally be the most convenient although, in principle, other shapes can be used.

Anion Membrane Selection

As discussed above, in principle, the invention will allow the reduction of the metal salt concentration in the plating electrolyte without changing the pH of the plating electrolyte. Because current efficiency at the cathode is often somewhat less than 100%, some hydrogen ions are converted to hydrogen gas. This phenomenon may under some practical circumstances cause the pH of the electroplating electrolyte to slowly rise. This rise in pH could be counteracted through direct addition of acid to the electroplating bath from time to time according to standard practice, or conventional insoluble anodes can be introduced as outlined in U.S. Pat. No. 4,778,572.

The present invention can be utilized to assist in balancing the pH of the plating bath.

It is well known that anion exchange membranes will allow a certain amount of back diffusion of acid. In this case, acid will diffuse from the first compartment 28 of a single membrane insoluble anode assembly 22, or the second compartment 46 of a double membrane insoluble anode assembly 22', into the electroplating electrolyte, thereby reducing the tendency for the pH to rise in the plating solution.

Various anion membranes will allow back diffusion of acid to different extents. Neosepta AFN, manufactured by Tokuyama Soda, for example, which is utilized for diffusion dialysis of acid solutions, is very permeable to acid. Neosepta AM-1, a more conventional anion membrane which is utilized for electrodialysis of brine and brackish waters, is somewhat less permeable to acid than AFN. A new membrane, Neosepta ACM is very impermeable to acid and as a result, has been used for concentration of dilute acid by electrodialysis (see for example Y. Kobuschi, Y. Matsunaga and Y. Noma, "Application of Ion Exchange Membranes to the Recovery of Acids by Diffusion Dialysis and Electrodialysis", Proceedings of Microsymposium on Macromolecules, Synthetic Polymeric Membranes, Walter de Gruyter & Co., New York). The variation in acid permeabilities with different anion membranes is the subject of a paper by Cherif et al. A.T. Cherif, C. Gavach, T. Cohen, P. Dagard and L. Albert, 1988. "Sulfuric Acid Concentration with an Electro-Electrodialysis Process". Hydrometallurgy, 21: 191–201.

The pH of the electroplating solution can therefore be controlled by changing the rate of back diffusion of acid across the anion membrane. This can be accomplished by any of four methods:

1. Varying the flow of water entering the compartment adjacent to the anion membrane varies the concentration of acid in this compartment. A higher flow and lower concentration of acid in this compartment will decrease the rate of acid diffusion across the anion membrane into the electroplating solution.
2. Varying the pH of the solution entering the compartment adjacent to the anion membrane will also vary the acid concentration in this compartment, thereby varying the rate of acid diffusion across the membrane.
3. An anion membrane with an appropriate acid permeability can be utilized. For example, use of Neosepta AFN will cause a large amount of acid back diffusion causing the pH of the electroplating bath to be lowered, while use of Neosepta ACM will minimize the amount of acid back diffusion, causing the pH of the electroplating bath to increase.

4. Some of the acid solution flushed from the compartment adjacent to the anion membrane can be recycled back to the electroplating solution to reduce the pH.

Flushing Liquid

If a solution of water, acid or base is employed to flush acid from the compartment adjacent to the anion membrane, it is important that the flow rate of this flushing liquid be controlled. The flow requirements will vary depending upon the amount of current flowing through the insoluble anode assembly as well as the acid or base concentration of the flushing liquid. Flow can be continuous or intermittent.

The current in the plating bath and the insoluble anode assembly can vary quite significantly. In many plating operations, periods occur where no workpieces are in the plating bath and no current is flowing. In addition, the total current in a given plating bath and the current through an insoluble anode assembly will vary from one load of workpieces to the next, depending upon the surface area of the workpieces and their shape.

If the flushing liquid flow rate is too high in relation to the insoluble anode assembly current, the acid concentration in the compartment adjacent to the anion membrane will be very low. This will increase the electrical resistance of the solution in this compartment and so reduce the current and/or increase the voltage requirements. If the flushing liquid flow rate is too low, the pH of the plating electrolyte will be reduced as discussed above. In order to maintain a constant acid concentration, the flow rate of flushing liquid admitted to the compartment adjacent to the anion membrane should be proportional to the current. The flow rate of flushing liquid required can be calculated from equation (5) which is derived from Faraday's law.

$$Q = \frac{0.0373\ I}{t_+ ([H^+]_o - [H^+]_i + [OH^-]_i)} \quad (5)$$

where,

Q=flushing liquid flow rate to first compartment (litres per hour)

I=insoluble anode assembly current (amperes)

$t_+$=anionic transport number through the anion membrane $[H^+]_o$=desired acid concentration in compartment adjacent to anion membrane (equivalents per litre)

$[H^+]_i$=acid concentration of flushing liquid (equivalents per litre)

$[OH^-]_i$=alkali concentration of flushing liquid (equivalents per litre)

Since the objective is to minimize the back diffusion of acid across the anion membrane from the first compartment to the plating bath, t can be assumed to be 1.0. If water is used for a flushing liquid, equation (5) can then be simplified to yield equation (5*b*).

$$Q = \frac{0.0373\ I}{([H^+]_o)} \quad (5b)$$

It has been found that where the pH of the plating bath is greater than 2.0 such as in Watts nickel plating, where Ionac MA3475 is employed, the acid concentration in the compartment adjacent to the anion membrane must be maintained at less than 2 equivalents per litre and preferably less than 0.5 equivalents per litre to avoid excessive back diffusion of acid into the plating electrolyte, which would cause the pH of the plating electrolyte to be reduced. At the same time, to achieve a reasonable voltage drop across the insoluble anode assembly and a reasonable current, the acid in the compartment adjacent to the anion membrane should be maintained at a concentration of greater than 0.05 equivalents per litre and preferably greater than 0.1 equivalents per litre to maintain reasonable electrical conductance.

In summary, if water is used to flush acid from the compartment adjacent to the anion membrane, the flow rate of water should be controlled in proportion to the insoluble anode assembly current so that the acid concentration in this compartment is in the range 0.05–2.0 equivalents per litre and preferably 0.1–0.5 equivalents per litre. The current carried by the insoluble anode assembly can be monitored by any one of a number of known current measuring devices. It is a relatively simple task to equip this current measuring device with an output signal proportional to the current. This signal can then be utilized to proportionally control a pump or valve that delivers the water.

Alkaline Catholyte

Even when a cation exchange membrane is employed, a certain quantity of chloride ions will diffuse through the cation membrane into the anode compartment, resulting in the production of small quantities of toxic chlorine gas. The gas evolving from the first (i.e. anode) compartment can be vented by a suitable fume extraction system to avoid any deleterious health effects.

The chlorine gas problem can alternately be further reduced or eliminated altogether by using an alkaline anolyte instead of an acidic anolyte. The use of an alkaline anolyte for suppressing evolution of chlorine gas is outlined in Japanese patent application SHO57-51477.

The pH of the anolyte is maintained basic or alkaline (pH=8–13) by regular additions of a base such as sodium hydroxide to the first (i.e. anode) compartment. By so doing, the hydrogen ions that are generated as a result of the electrolysis of water at the anode according to equation (4) are neutralized.

When an alkaline anolyte is employed, the majority of ion transfer through the cation membrane is the alkaline cation (e.g. $Na^+$) instead of hydrogen. As a result of this cationic transfer and the transfer of anions through the anion membrane, a buildup of salt is experienced in the second compartment instead of a buildup of acid. This results in less back diffusion of hydrogen ions into the electroplating bath, which as discussed above, is advantageous. The buildup of salt concentration in the second compartment can be counteracted by flushing the compartment with water.

Elimination of Soluble Anodes

There are circumstances in which it will be advantageous to eliminate the soluble metal anodes and employ insoluble anodes exclusively. This could occur for example where the cost of metal salts is lower than that of metal anode material. Insoluble anodes are currently employed in applications such as zinc electrogalvanizing, where the use of soluble anodes is not convenient. In this case, the metal is added by dissolving elemental metal or oxide in the solution which co-incidentally neutralizes the acidity generated at the insoluble anodes. The present invention could be advantageously applied under such circumstances, since the metal could be added as a salt (e.g. metal sulfate or metal chloride) without creating a problem with acid buildup in the plating solution.

The rate at which the metal salt concentration in the electroplating bath is decreased depends on the amount of current carried by the insoluble anode assembly. One way to increase this current is to increase the size, or number of insoluble anode assemblies of a given size, employed in the bath.

Auxiliary Power Supply

One problem with using insoluble anodes is that the potential required for evolution of oxygen at the insoluble anodes is greater than the potential required for dissolution of metal from the soluble anodes. As a result, the current density obtained from the insoluble anode is significantly lower than that obtained from the soluble anodes when operated at the same potential. Consequently, a greater quantity of insoluble anode material is required to remove metal from the electroplating bath at a given rate than would otherwise be the case. In addition, the current distribution in the plating bath would be non-uniform. This problem is exacerbated by the use of ion exchange membranes in conjunction with the insoluble anode, due to the voltage drop across the membrane. In some cases, the difference in potential between metal dissolution and oxygen evolution is so great that an insoluble anode will generate no oxygen and will therefore carry no current whatsoever.

In such cases, it is necessary to apply a higher potential to the insoluble anode than the soluble anode to obtain current from the insoluble anode and to obtain a uniform current distribution in the plating bath. This can be accomplished by modifying the design of the electrical circuit or through use of separate power supplies for the soluble and insoluble anodes. Such techniques are familiar to those skilled in the art.

One method for supplying a higher potential to the insoluble anode assembly is by using an auxiliary power supply as illustrated in FIG. 4. The positive terminal from the primary power supply 42' is connected to the soluble anode 38'. The positive terminal from the auxiliary power supply 48' is connected to the insoluble anode assembly 20'. The negative terminals from both power supplies are connected to the cathode workpiece 40'. The voltage from the auxiliary power supply is greater than the voltage from the primary power supply. By this means the current density at the insoluble anode assembly can be adjusted so that it is approximately the same as at the soluble anodes and a fairly even current distribution will be obtained in the electroplating bath. There are other possible electrical connection arrangements (not shown) which will achieve the desired objective of increasing the potential applied to the insoluble anode assembly beyond that of the soluble anodes and achieving even current distribution in the electroplating bath. It will be understood that these other connection arrangements can be employed within the scope of this invention.

It will of course be appreciated that the preceding description relates to particular preferred embodiments of the invention and that many modifications are possible. Some of those modifications have been indicated previously and other will be apparent to a person skilled in the art.

I claim:

1. A process for electroplating metals in an electroplating bath which contains a plating solution of a metallic salt, and a cathode comprising a workpiece to be plated, the process comprising the steps of:

providing in said bath an insoluble anode assembly including an anode which is essentially insoluble during electroplating, and an enclosure which defines a compartment around said insoluble anode containing a solution of an electrically conductive acid, base or salt, said enclosure isolating the solution in said compartment from the plating solution and comprising at least in part an anion exchange membrane;

connecting a source of direct electric current across the anode and cathode so that metal is deposited onto the cathode, wherein the primary reac.tion at the insoluble anode is electrolysis of water to produce predominantly oxygen and hydrogen ions, and the flow of current through the insoluble anode assembly causes anions in the plating solution to travel through the anion membrane into said compartment, resulting in an increase in acid concentration in said compartment;

at least periodically flushing accumulated acid from said compartment.

2. A process as claimed in claim 1, wherein the bath also includes a soluble anode which is connected to said source of direct electric current in parallel with said insoluble anode, and wherein the insoluble anode carries an amount of anodic current that is selected to result in the total amount of metal deposited on the cathode being greater than the total amount of metal dissolved from the soluble anode.

3. A process as claimed in claim 2, wherein the electrical potential applied to the insoluble anode assembly is higher than the electrical potential applied to the soluble anode.

4. A process as claimed in claim 1, wherein said step of at least periodically flushing accumulated acid is performed by circulating through said compartment a flushing liquid that is lower in acid concentration than the liquid in the compartment.

5. A process as claimed in claim 4 wherein the pH of the plating solution is controlled by varying the flow rate and acid concentration of said flushing liquid.

6. A process as claimed in claim 4, wherein the flushing liquid is water.

7. A process as claimed in claim 4, wherein the pH of the electroplating solution is greater than approximately 2.0, and wherein the flushing liquid is admitted to said compartment at a flow rate selected to hold the acid concentration in said compartment between 0.05 and 2.0 equivalents per litre.

8. A process as claimed in claim 7, wherein the flow rate of the flushing liquid is selected to hold the acid concentration between 0.1 and 0.5 equivalents per litre.

9. A process as claimed in claim 4, wherein the flow of flushing liquid is controlled at a rate which is proportional to the current flowing in the insoluble anode assembly.

10. A process as claimed in claim 4, wherein said compartment around the insoluble anode is a first compartment, and wherein said insoluble anode assembly further includes a cation exchange membrane disposed between said electrode and said anion exchange membrane, whereby a second compartment is defined between the two membranes, said second compartment containing a solution of electrically conductive acid or salt, and wherein said flushing step comprises flushing liquid from said second compartment.

11. A process as claimed in claim 10, wherein the solution in said first compartment is maintained at a pH greater than 7.

12. A process as claimed in claim 10, wherein the cation exchange membrane is a perfluorosulfonic acid type.

13. A process as claimed in claim 10, wherein said first compartment contains dilute sulfuric acid.

14. An apparatus for electroplating metals comprising:

an electroplating tank adapted to contain a plating solution of a metallic salt and a cathode comprising a workpiece to be plated;

an insoluble anode assembly disposed in said tank and including an anode which is essentially insoluble during electroplating, and an enclosure which defines a compartment around said insoluble anode for containing a solution of an electrically conductive acid, base or salt, said enclosure being adapted to isolate the solution in said compartment from the plating solution and comprisign at least in part an anion exchange membrane;

a source of direct electric current for connection across the anode and cathode to cause deposition of metal onto the cathode, whereby the primary reaction at the insoluble anode is electrolysis of water to produce predominantly oxygen and hydrogen ions, and the flow of current thorugh the insoluble anode assembly causes anions in the plating solution to travel through the anion membrane into said compartment, resulting in an icnrease in acid concentration in said compartment; and, means for flushing accumulated acid from said compartment.

15. An apparatus as claimed in claim 14, wherein the tank also contains a soluble anode which is connected to said source of direct electric current in parallel with said insolubel anode, and wherein the proportion of insoluble anode material to soluble anode material is selected so that, in use, the insoluble anode carries an amount of anodic current that results in the total amount of metal deposited on the cathode being greater than the total amount of metal dissolved from the soluble anode.

16. An apparatus as claimed in claim 15, wherein said source of direct electric current comprises a primary power supply having a positive terminal connected to said soluble anode, and a negative terminal connected to said cathode, and an auxiliary power supply having a positive terminal connected to the insoluble anode of the insoluble anode assembly, and a negative terminal connected to said cathode, wherein the auxiliary power supply is adapted to apply a higher electrical potential to the insoluble anode than the potential applied to the soluble anode by the primary power supply.

17. An apparatus as claimed in claim 14, wherein said compartment around the insoluble anode is a first compartment, and wherein said insoluble anode assembly further includes a cation exchange membrane disposed between said electrode and said anion exchange membrane, whereby a second compartment is defined between the two membranes, said second compartment being adapted to contain a solution of electrically conductive acid or salt, and wherein said flushing means is arranged to flush liquid from said second compartment.

18. An apparatus as claimed in claim 17, wherein the cation exchange membrane is a perfluorosulfonic acid type.

19. An apparatus as claimed in claim 17, wherein said first compartment being adapted to contain dilute sulfuric acid.

20. An apparatus as claimed in claim 17, wherein each of said membranes has a generally cylindrical configuration, with the cation membrane being of smaller diameter than and located within the anion exchange membrane, whereby said second compartment has an annular configuration and a first compartment has a cylindrical configuration.

21. An apparatus as claimed in claim 14, wherein said membrane has a generally cylindrical configuration, whereby said compartment also has a cylindrical configuration.

* * * * *